US005720122A

United States Patent [19]

McLellan

[11] Patent Number: 5,720,122

[45] Date of Patent: Feb. 24, 1998

[54] PLOW BLADE WITH ADJUSTABLE SCRAPING BAR

[76] Inventor: Jeffrey S. McLellan, 145 Brickyard Rd., Farmington, Conn. 06032

[21] Appl. No.: 639,689

[22] Filed: Apr. 29, 1996

[51] Int. Cl.[6] ..... E01H 5/04

[52] U.S. Cl. ..... 37/233; 37/232; 37/266

[58] Field of Search ..... 37/232, 233, 264, 37/265, 266, 270, 271; 172/264, 265, 260.5, 270

[56] References Cited

U.S. PATENT DOCUMENTS

| | | | |
|---|---|---|---|
| 1,544,795 | 7/1925 | Barrett . | |
| 2,055,291 | 9/1936 | Henry | 37/279 |
| 3,014,289 | 12/1961 | Torrey | 37/283 |
| 3,772,803 | 11/1973 | Cote | 37/42 |
| 3,808,714 | 5/1974 | Reissinger et al. | 37/42 |
| 4,259,794 | 4/1981 | Rath | 37/232 X |
| 4,307,523 | 12/1981 | Reissinger et al. | 37/232 X |
| 4,843,744 | 7/1989 | Jansen | 37/232 |
| 4,991,323 | 2/1991 | Benkler | 37/232 X |
| 5,109,618 | 5/1992 | Grübler et al. | 37/232 |
| 5,140,763 | 8/1992 | Nichols, IV | 37/233 |
| 5,155,929 | 10/1992 | Vachon | 37/232 X |
| 5,191,729 | 3/1993 | Verseef | 37/232 |
| 5,437,113 | 8/1995 | Jones | 37/233 |
| 5,477,600 | 12/1995 | Houle et al. | 37/279 |

OTHER PUBLICATIONS

Promotional Literature–Maher's Welding Service, Inc. (No date).

*Primary Examiner*—Terry Lee Melius
*Assistant Examiner*—Robert Pezzuto
*Attorney, Agent, or Firm*—McCormick, Paulding & Huber

[57] ABSTRACT

A plow blade assembly for clearing a surface during a plowing operation comprises a plow blade having a front and rear surface and a lower edge. The plow blade is pivotally supported on a support frame for movement between a forward and a retracted position. The plow blade is normally resiliently retained in the forward position. An actuator is flexibly connected to the plow blade so that the position of the blade can be selectively varied and maintained at a location between the forward and retracted positions.

16 Claims, 6 Drawing Sheets

FIG. 3

PLOW BLADE WITH ADJUSTABLE SCRAPING BAR

FIELD OF THE INVENTION

The present invention relates to the field of material removal using a plow, and deals more particularly with a plow blade having an adjustable scraping bar.

BACKGROUND OF THE INVENTION

The present invention has particular utility in connection with the removal of material from a surface by plowing and is described herein as applied to such use. In general, during a plowing operation, a plow blade is employed to push material off of the surface being cleared. However, as is often the case, material can accumulate or drift against a barrier like the wall or garage door of a house. In these situations, the standard plowing method cannot be used. A technique known to those skilled in the art as "back blading" must be utilized to remove the accumulated material.

During a back blading operation, the rear of the plow blade is used as the working surface of the plow. The operator initially positions the bottom edge of the plow blade as close as possible to the barrier against which the material has accumulated. As the plow backs away, the rear surface of the plow blade acts to pull the accumulated material away from the barrier.

In the past, conventional back blading was not very efficient. This was due to the convex camber of the rear surface of the plow blade. The lower edge of the plow blade assumed a semi-tangential relationship with the surface being cleared. Therefore, during a back blading operation, the blade's lower edge had a tendency to ride on top of the material, and several passes were required to scrape the material off of the surface being cleared.

To avoid the necessity of making multiple passes when back blading a surface, it is important to orient the plow blade, or a portion thereof, perpendicular to the surface being cleared. Moreover, to achieve optimal results, the orientation angle of the lower portion of the plow blade with respect to the surface being cleared should be adjustable such that during operation, the plow blade can be made to follow the surface's contours.

Accordingly, the general object of the present invention is to provide a plow blade which can efficiently back blade a surface in a minimum number of passes.

It is a further object of the present invention to provide a mechanism for selectively controlling the angle of orientation between the lower edge of the plow blade and the surface to be cleared.

It is still another object of the present invention to provide a means for retrofitting existing plow blades such that they may be used to efficiently back blade a surface.

SUMMARY OF THE INVENTION

The present invention resides in a plow blade assembly for clearing a surface in a plowing operation comprising a plow blade having a front surface, a rear surface and a lower edge. The plow blade is pivotally mounted on a plow support frame for movement between a forward and a retracted position. A biasing means is connected to the plow blade for normally maintaining the plow blade in the forward position. A positioning means is connected to the plow blade for selectively varying and maintaining the position of the plow blade between the forward and retracted position against the force applied by the biasing means.

In an alternate embodiment, a scraping bar is mounted to the lower edge of the plow blade such that it can pivot between a forward position and a retracted position. A biasing means is connected to the scraping bar in order to normally maintain the scraping bar in the forward position with respect to the plow blade. A positioning means is flexibly connected to the scraping bar for selectively varying and maintaining the position of the scraping bar between the forward and retracted position with respect to the plow blade and against the force applied by the biasing means.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
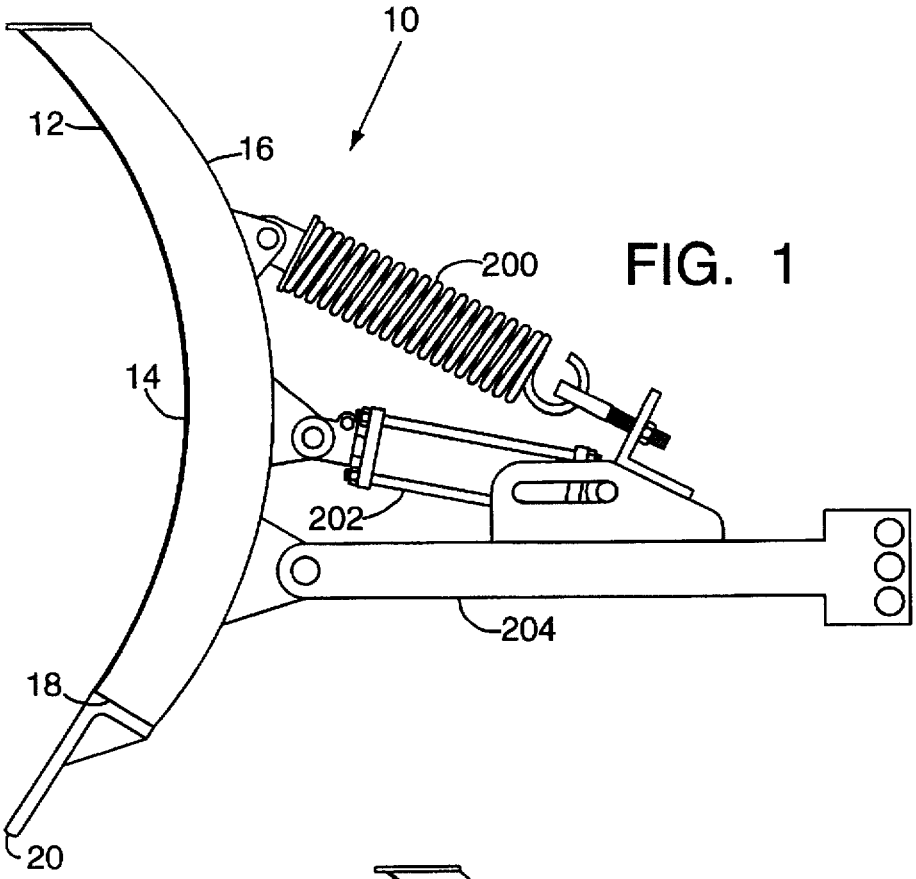
FIG. 1. is a side view of the plow blade assembly showing a hydraulic position means.

Turning to the drawings and first referring to FIG. 1 the preferred embodiment of a plow blade assembly for clearing a surface in a plowing operation, there shown and generally designated as 10, comprises a plow blade 12, having a front surface 14, a rear surface 16, and a lower edge 18. The plow blade is pivotally mounted to a plow support frame 204. A biasing means 200 is connected to the plow blade rear surface 16 for normally maintaining the plow blade 12 in the forward position yet allowing the plow blade to deflect towards the retracted position during a conventional plowing operation when an obstacle such as a rock or manhole cover is encountered. A positioning means 202 is flexibly connected to the plow blade 12 such that during a back blading operation the angle of orientation between the plow blade lower edge 18 and the surface being cleared can be selectively varied and held against the force exerted by the springs 200 at any point between the forward and the retracted positions.

Figure 2:
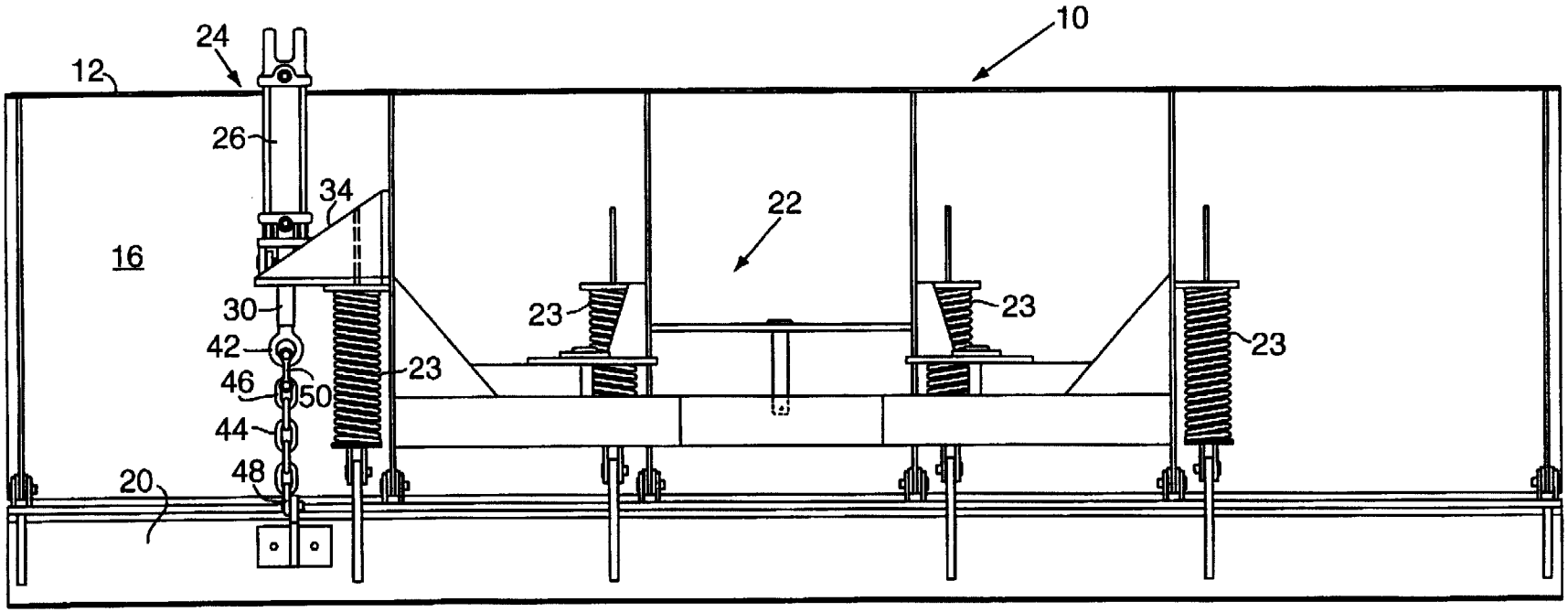
FIG. 2 is a rear view of the plow blade assembly showing a pivotally mounted scraping bar and hydraulic positioning means
Figure 3:
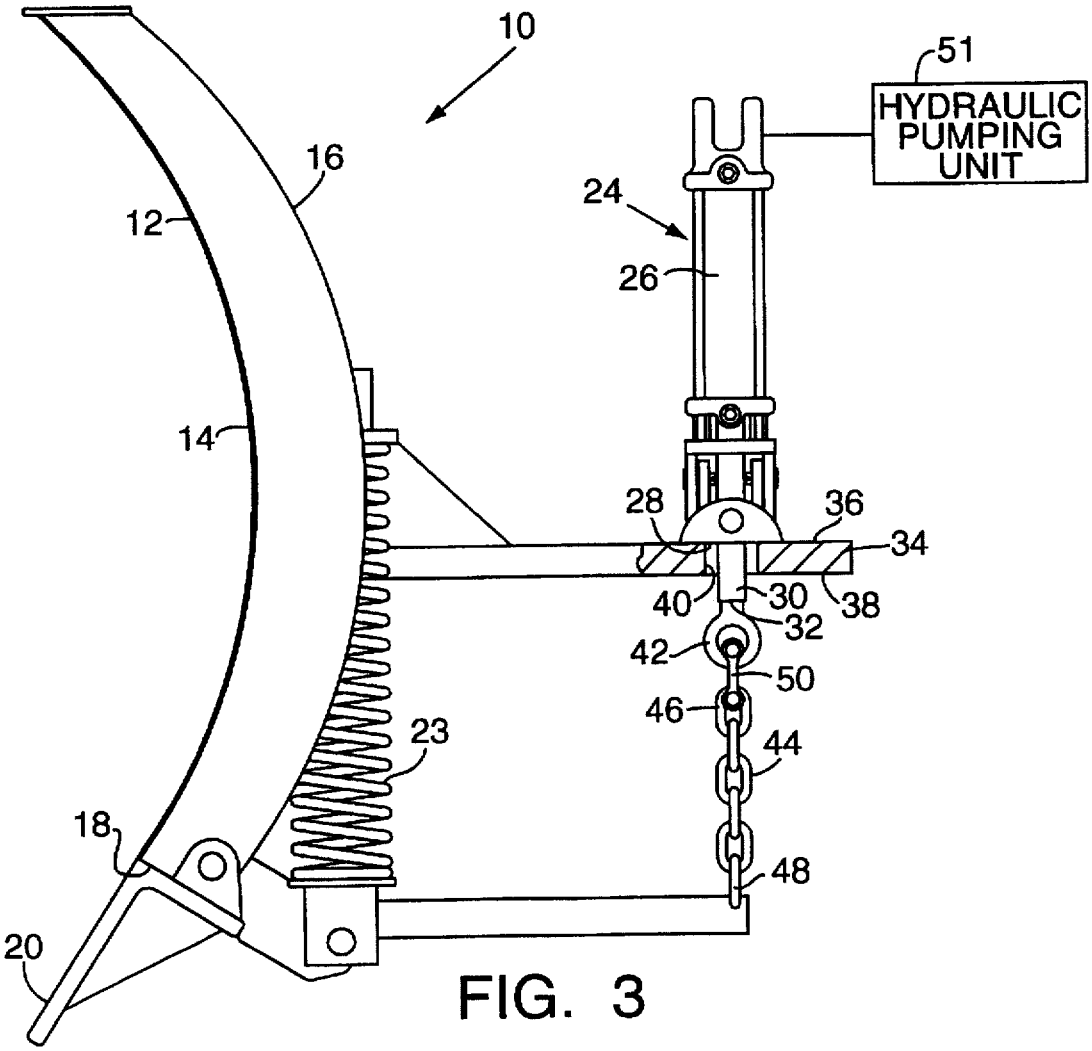
FIG. 3 is a side elevation partly in section view of the plow blade assembly showing the hydraulic positioning means and the scraping bar in the normally forward position.
Figure 4:
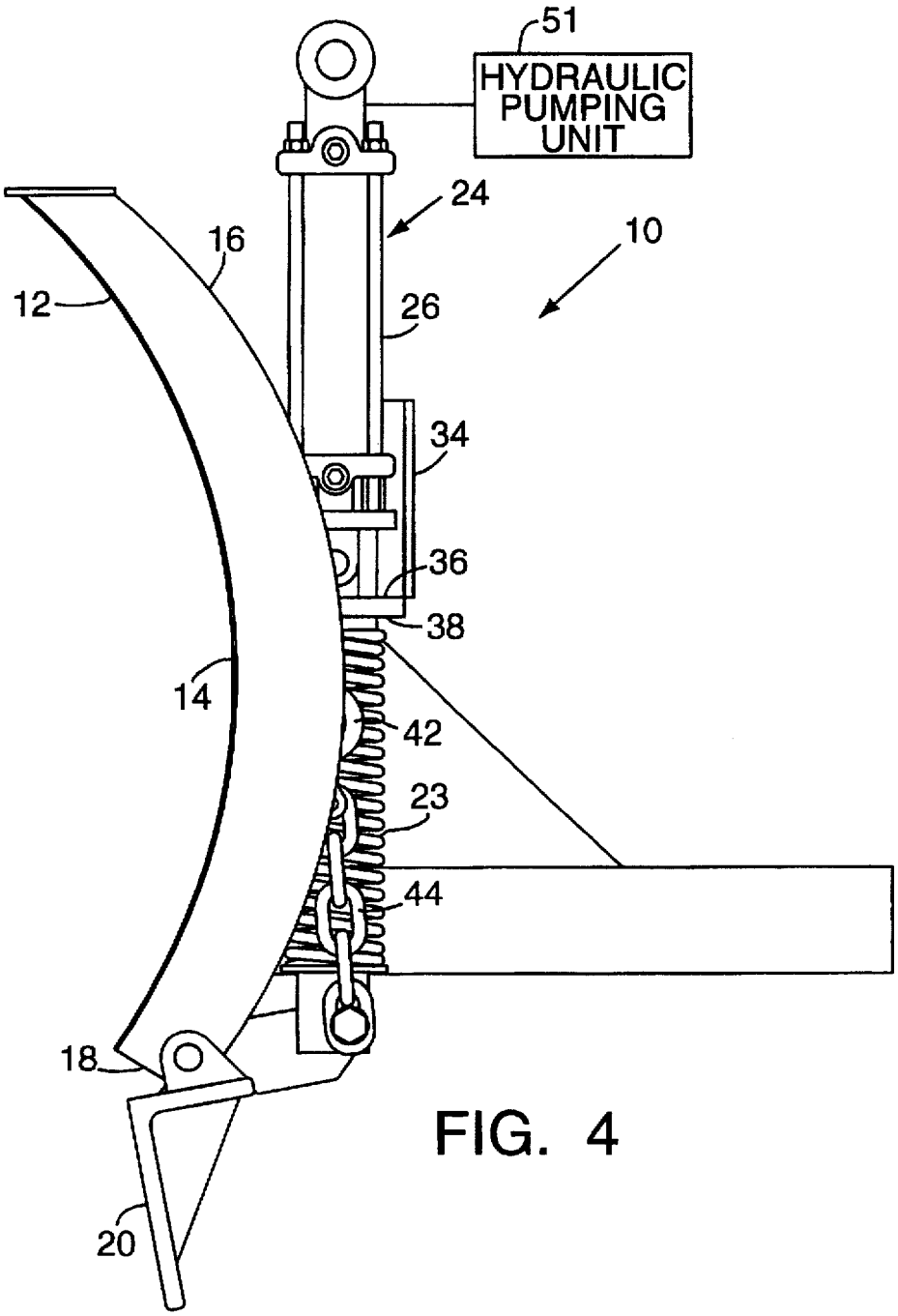
FIG. 4 is a side elevation partly in section view of the plow blade assembly showing the hydraulic positioning means and the scraping bar in the retracted position.

Referreing now to FIGS. 2, 3 and 4, an alternate embodiment of a plow blade assembly for clearing a surface in a plowing operation comprises, a scraping bar 20 pivotally mounted to the lower edge 18 of the plow blade 12 for movement between a forward position, as shown in FIG. 3, and a retracted position, shown in FIG. 4, defined with respect to the plow blade 12. A biasing means 22 is connected to the scraping bar 20 for normally maintaining the scraping bar 20 in the forward position yet allowing the scraping bar to deflect towards the retracted position during a conventional plowing operation when an obstacle such as a rock or manhole cover is encountered.

Still referring to FIG. 2, the aforementioned biasing means 22 consists of a plurality of coil springs 23 interposed between the plow blade rear surface 16 and the scraping blade 20 for urging the scraping blade toward the normally forward position.

A positioning system generally designated 24 is attached to the plow blade rear surface 16 and flexibly connected to the scraping bar 20 such that during a back blading operation the angle of orientation between the scraping bar 20 and the surface being cleared can be selectively varied and held against the force exerted by the springs 23 at any point between the forward and the retracted positions.

Turning now to FIG. 2 through 4, the positioning system 24 comprises, a bracket 34 attached to the plow blade rear surface 16. The bracket 34 has an upper surface 36 and a lower surface 38. A slot 40 extends through the bracket 34. A reciprocating hydraulic cylinder 26 having a lower face 28 and a rod 30 extending from the lower face is pivotally mounted to the bracket 34 such that the rod 30 extends through and can pendularly move within the slot 40 in the bracket. A coupling means in the form of an eye bolt 42 is carried by end 32 of the rod 30. A chain 44 having opposed ends 46 and 48 is connected at end 48 as shown in FIGS. 2 through 4 to the scraping bar 20. The other end 46 of the chain 44 is connected to the eye bolt 42 at the end of rod 30 by shear pin 50 such that during a back blading operation, if the force transmitted from the scraping blade 20 through the chain 44 becomes greater than the load carrying capability of the shear pin 50, the shear pin will fracture. This will protect the hydraulic cylinder 26 by preventing dangerously high levels of force or shock loads from reaching the cylinder. While a chain has been shown and described, many other types of flexible tension carrying members known to those skilled in the art may be substituted without departing from the broader aspects of the invention.

The hydraulic cylinder 26 is pressurized by a hydraulic pumping unit 51. In lieu of, or in addition to, the aforementioned shear pin 50, the hydraulic pumping unit can carry a pressure relief means such that if the force exerted against the scraping blade during a back blading operation approaches a level capable of damaging the hydraulic cylinder 26, the pressure supplied to the cylinder 26 will abate thereby relieving the transmitted force. During operation, the hydraulic pumping unit can be actuated by the plow operator to selectively extend or retract the hydraulic cylinder rod 30 such that the coaction of rod 30 and chain 44 causes the scraping blade 20 to move and be held at a point between the forward and retracted positions.

While a hydraulic cylinder and pumping unit have been described, it is to be understood that the present invention is not limited in this regard and other means of positioning the scraping bar may be substituted without departing from the broader aspects of the invention.

Figure 5:
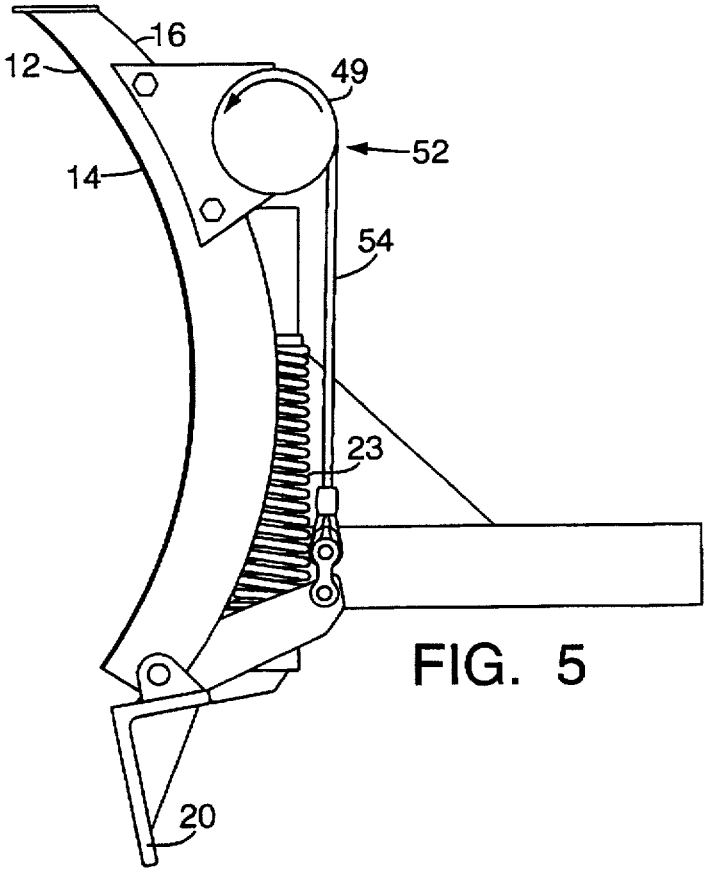
FIG. 5 is a side elevation view of the plow blade assembly showing a winch positioning means and the scraping bar in the retracted position.

For example, FIG. 5 illustrates a scraping bar positioning means actuated by a winch 49 mounted to the rear surface 16 of the plow blade 12. The winch 49 has an integral barrel 52 selectively rotatable in either the clockwise or counterclockwise directions. A flexible member 54 of suitable construction, such as, a chain or cable, is connected to the scraping blade 20 and the winch barrel 52 such that when the plow operator selectively actuates the winch 49, the winch and the cable coact to move and hold the scraping bar 20, depending on the direction of rotation of the integral barrel 52, to a point between the previously discussed forward and retracted positions.

Figure 6:
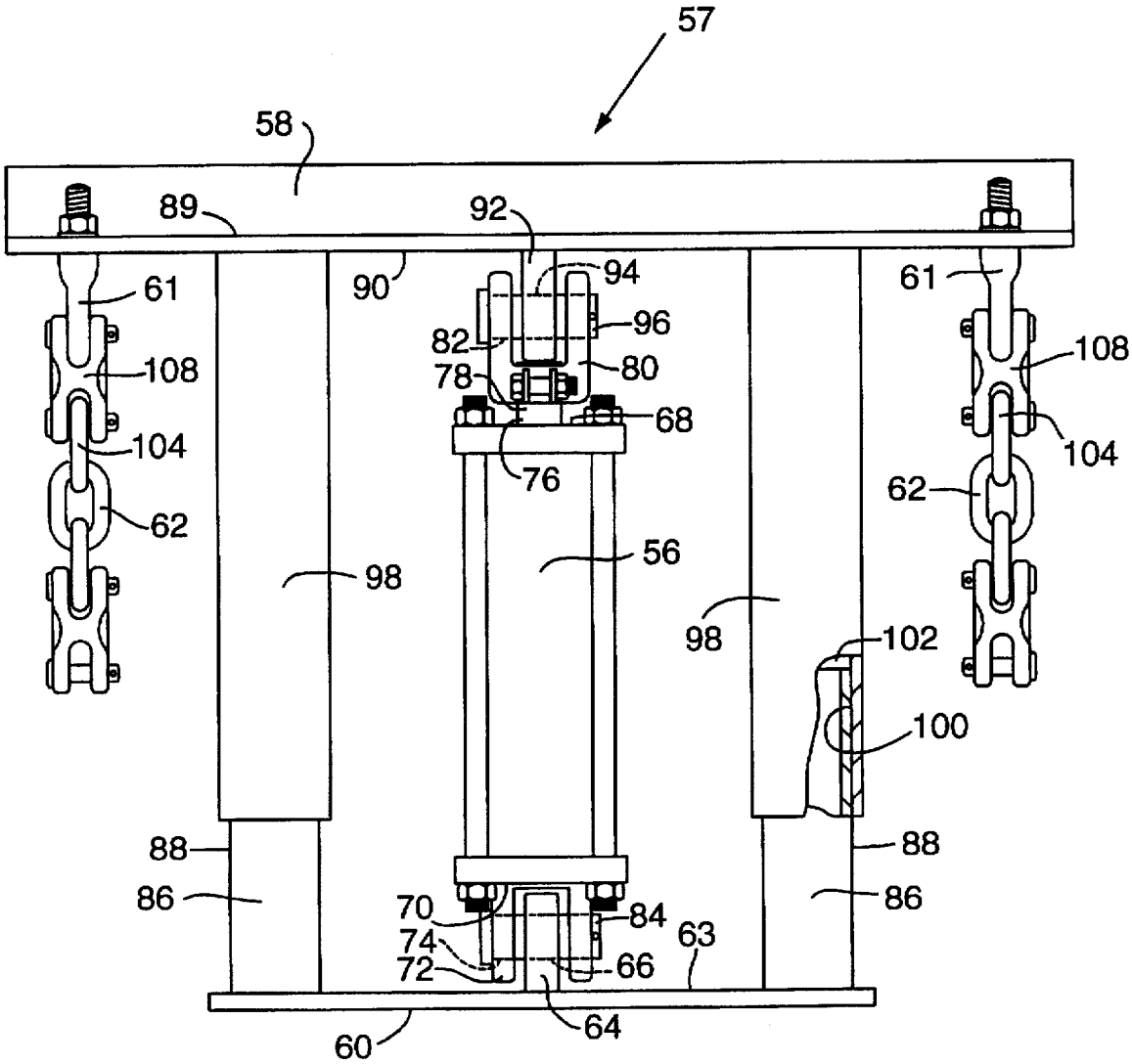
FIG. 6 is a front elevational view of the plow blade assembly showing a telescopic hydraulic positioning means.
Figure 7:
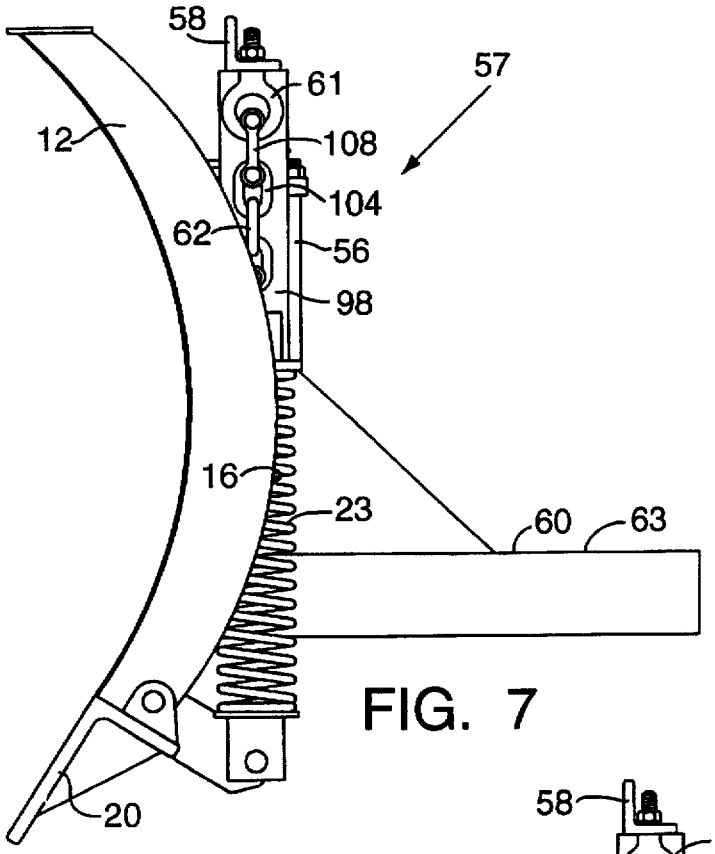
FIG. 7 is a side elevational view of the plow blade assembly showing the telescopic hydraulic positioning means and the scraping bar in the normally forward position.
Figure 8:
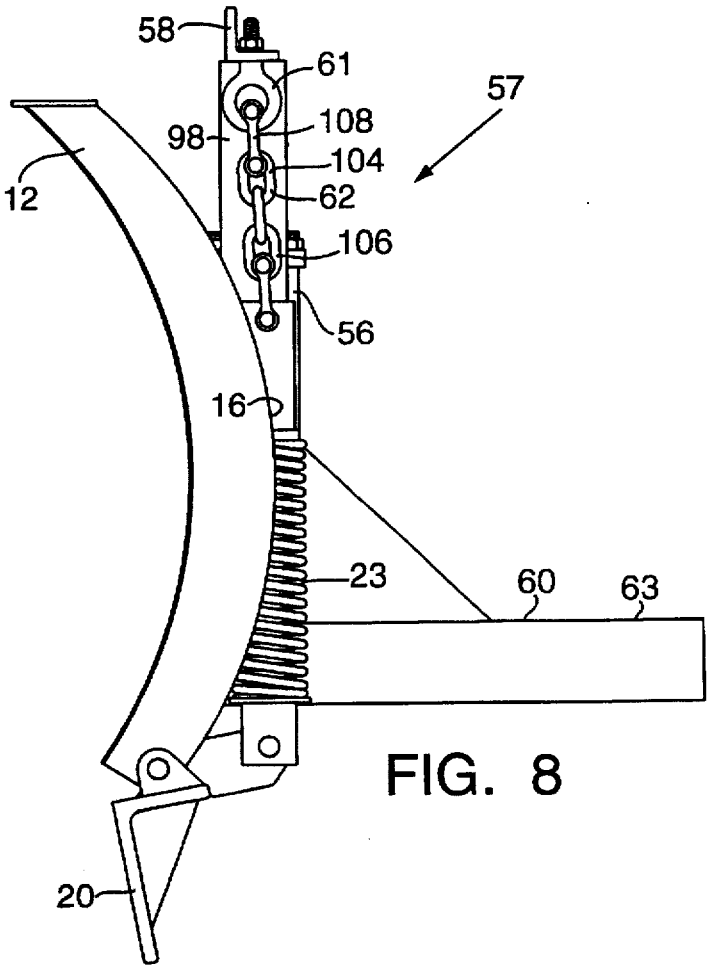
FIG. 8 is a side elevational view of the plow blade assembly showing the telescopic hydraulic positioning means and the scraping bar in the retracted position.

Another embodiment of the scraping blade positioning system is shown in FIGS. 6 through 8. The system generally designated as 57 comprises a reciprocating hydraulic cylinder 56 interposed between and pivotally connected to both an upper bracket 58, and a lower bracket 60. A hydraulic pump unit (not shown) is employed to selectively pressurize the hydraulic cylinder 56. A pair of eyebolts 61, 61 are attached to the upper bracket and a pair of chains 62, 62 are interposed between and connected to the eyebolts 61, 61 and the scraping blade 20.

Similarly to the first positioning system 24 described above, this embodiment of the invention incorporates a reciprocating hydraulic cylinder 56 as the means for positioning the scraping blade 20, the cylinder having an upper surface 68, and a lower surface 70. A first clevis 72 is attached to the lower surface 70 of the cylinder 56. A bore 74 extends through and is perpendicular to the first clevis 72. A rod 76 having an end 78 extends upwardly from the upper surface 68 of the hydraulic cylinder 56. A second clevis 80 is attached to the rod end 78. Similar to the first clevis 72, the second clevis 80 has a bore 82 extending through and perpendicular to the second clevis 80.

The lower bracket 60 is attached to the plow blade rear surface 16 as best seen in FIGS. 7 and 8 and has a top surface 63. A boss 64 upwardly depends from the top surface 63. A bore 66 extends through and is perpendicular to the boss 64. The boss 64 being positioned within the first clevis 72 such that the bore 66 in the lower bracket boss, and the bore 74 in the first clevis are substantially aligned. A first clevis pin 84 extends through the bores 66 and 74, thereby pivotally mounting the lower surface 70 of the hydraulic cylinder 56 to the lower bracket 60.

The lower bracket 60, is further defined by a pair of substantially parallel opposed bars 86, 86 having exterior surface 88, 88. The bars 86, 86 being equally spaced on either side of the lower bracket boss 64 and extending upwardly from the top surface 63 of the lower bracket 60.

The upper bracket 58, shown in FIG. 6, has a top surface 89 and a bottom surface 90. A boss 92 downwardly depends from the bottom surface 90 of the upper bracket 58. A bore 94 extends through and is perpendicular to the boss 92. The boss 92 being positioned within the second clevis 80 such that the bore 94 in the upper bracket boss, and the bore 82 in the second clevis 80 are substantially aligned. A second clevis pin 96 extends through the bores 82 and 94, thereby pivotally mounting the hydraulic cylinder rod 76 to the upper bracket 58.

The upper bracket 58 is further defined by a pair of substantially parallel opposed tubes 98, 98, each tube being equally spaced apart on either side of the upper bracket boss 94 and downwardly extending from the upper bracket bottom surface 90. The opposed tubes 98, 98 have an interior surface 100 defining an interior area 102. The interior area is shaped to telescopically receive the exterior surface 88 of the lower bracket opposed bars 86, 86. As best seen in FIG. 8, the aforementioned chains 62, 62 are coupled at one end of the chain 106 to the scraping bar 20 and at the other end 104, 104 to shear pins 108, 108. The shear pins in turn are coupled to the eyebolts 61, 61 which are equally spaced apart outboard of the opposed tubes 98, 98 on the bottom surface 90 of the upper bracket 58. While eyebolts are shown and described, it is to be understood that many other types of coupling means known to those skilled in the art may be substituted without departing from the broader aspects of the invention. The shear pins 108, 108 are incorporated into the device to prevent any damage to the hydraulic cylinder 56 during a back blading operation. During back blading, if the force transmitted from the scraping blade 20 through the chains 62, 62 becomes greater than the load carrying capability of the shear pins 108, 108, the shear pins will fracture thereby preventing dangerously high levels of force or shock loads from reaching the cylinder.

In lieu of, or in addition to the aforementioned shear pins 108, 108, the hydraulic pumping unit can carry a pressure relief means such that if the force exerted against the scraping blade 20 during a back blading operation approaches a level capable of damaging the hydraulic cylinder 56, the pressure supplied to the cylinder 56 will abate thereby relieving the transmitted force.

During a plowing, when back blading becomes necessary, the operator can selectively actuate the hydraulic pumping unit thereby causing the cylinder rod 76 to extend or retract. As the rod extends or retracts, the upper bracket 58 is respectively raised or lowered thereby causing the scraper bar 20 to be moved and held at a point between the previously described forward and retracted positions. Alignment between the upper and lower brackets 58 and 60, when the cylinder rod 76 is in motion, is maintained via the telescopic relationship between the bars 86, 86 on the lower bracket 60 and the tubes 98, 98 on the upper bracket 58.

It is to be understood that the forms of the invention shown and described herein are to be taken as preferred embodiments of the same, and that various changes in the selection of parts comprising the broadly defined means and in the arrangement of said parts may be resorted to without departing from the spirit of the invention or the scope of the following claims.

I claim:

1. A plow blade assembly for clearing a surface in a plowing operation comprising:

a plow blade having a front surface, a rear surface, and a lower edge;

said plow blade being pivotally supported on a plow support frame for movement between a forward position and a retracted position;

a biasing means connected to said plow blade for exerting a force against said plow blade to normally maintain, said plow blade in said forward position, said biasing means permitting said plow blade to deflect toward said retracted position when an obstacle is encountered during said plowing operation; and a positioning means flexibly connected to said plow blade for selectively varying and maintaining the angle of orientation of said lower edge of said plow blade, with respect to said surface, between said forward and said retracted positions during said plowing operation, against said force applied to said plow blade by said biasing means.

2. The plow blade assembly of claim 1 wherein the biasing means comprises at least one spring interposed between and connected to said plow support frame and said plow blade rear surface.

3. The plow blade assembly of claim 1 further comprising:

at least one scraping bar pivotally mounted to said lower edge of said plow blade for movement between said forward position and said retracted position defined with respect to the plow blade;

said biasing means being connected to said scraping bar for normally maintaining said scraping bar in said forward position with respect to said plow blade; and said positioning means being flexibly connected to said scraping bar for selectively varying and maintaining the angle of orientation of said scraping bar relative to said surface between said forward and said retracted position during said plowing operation against the force applied to said scraping bar by said biasing means.

4. The plow blade assembly of claim 3 wherein said positioning means comprises:

a reciprocating hydraulic cylinder having a lower face and a rod extending from said lower face, said rod having an end and being selectively retractable or extendible upon pressurization of said hydraulic cylinder;

coupling means carried by said rod end;

means for selectively pressurizing said hydraulic cylinder;

a bracket attached to said plow blade rear surface, said bracket having an upper and lower surface and a slot extending through said bracket from said upper to said lower surface;

means for pivotally mounting said hydraulic cylinder to said bracket upper surface such that said rod end and said coupling means extend through and can pendularly move within said slot in said bracket; and a flexible member having opposed ends, said flexible member being connected at one of said opposed ends to said scraping bar and at the other of said opposed ends to said coupling means such that when said hydraulic cylinder is selectively pressurized, said rod and said flexible member coact to move and hold said scraping bar between said forward and said retracted positions.

5. The positioning means of claim 4 further comprising:

a shear pin connecting one of said opposed ends of said flexible member to said coupling means such that if a force sufficient to damage said hydraulic cylinder is transmitted through said flexible member, said shear pin will fracture thereby preventing said force from reaching said hydraulic cylinder.

6. The positioning means of claim 4 wherein said coupling means is an eye bolt.

7. The positioning means of claim 4 wherein said coupling means is a clevis.

8. The means for selectively pressurizing said hydraulic cylinder of claim 4 including a pressure relieving means for abating said pressure applied to said hydraulic cylinder such that if an excessive pressure is generated within said hydraulic cylinder, said pressure relieving means will act to reduce said pressure thereby preventing damage to said hydraulic cylinder.

9. The plow blade assembly of claim 3 wherein said positioning means comprises:

a flexible member having opposed ends;

a winch attached to said plow blade rear surface, said winch having an integral barrel selectively rotatable in either the clockwise or counterclockwise directions; and said flexible member being connected at one of said opposed ends to said scraper bar and at the other of said opposed ends to said integral winch barrel such that when said winch is actuated, depending on the direction of rotation of said winch barrel, said flexible member will either unwind from or wind around, said winch barrel thereby moving and holding said scraping bar between said forward and said retracted positions respectively.

10. The plow blade assembly of claim 3 wherein said positioning means comprises:

an actuator;

a lower bracket attached to said plow blade, said lower bracket having a top surface and a pair of spaced apart substantially parallel opposed bars extending upwardly from said top surface of the lower bracket, said opposed bars having an exterior surface;

an upper bracket having, a top and bottom surface and a pair of substantially parallel opposed tubes downwardly extending from said upper bracket bottom surface, said opposed tubes having an interior surface defining an interior area, said interior area being shaped to receive said exterior surface of said lower bracket opposed bars;

said lower bracket opposed bars being telescopically engaged with said upper bracket opposed tubes;

said actuator being interposed between and in communication with said upper and lower brackets;

a pair of coupling means attached to said upper bracket lower surface, each of said coupling means being spaced apart from the other and positioned outboard of said upper bracket opposed tubes; and a pair of flexible members having opposed ends, each of said pair of flexible members being attached at one of said opposed ends to one of said coupling means and at the other of said opposed ends to said scraping bar such that when said actuator is selectively operated said upper bracket coacts with said flexible members to move and hold said scraping bar between said forward and said retracted positions.

11. The positioning means of claim 10 wherein said actuator comprises a reciprocating hydraulic cylinder and a hydraulic pumping unit.

12. The positioning means of claim 10 wherein said coupling means comprises an eye bolt.

13. The positioning means of claim 10 wherein said coupling means comprises a shackle.

14. The positioning means of claim 10 wherein said coupling means comprises a clevis.

15. The positioning means of claim 10 further comprising:

a pair shear pins;

one of said shear pins connecting one of said opposed ends of one of said flexible members to one of said pair of coupling means; and the other one of said shear pins connecting one of said opposed ends of the other of said flexible members to the other of said coupling means such that if a force sufficient to damage said hydraulic cylinder is transmitted through said flexible members, said shear pins will fracture thereby preventing said force from reaching said hydraulic cylinder.

16. The means for selectively pressurizing said hydraulic cylinder of claim 10 including a pressure relieving means for abating said pressure applied to said hydraulic cylinder such that if an excessive pressure is generated within said hydraulic cylinder, said pressure relieving means will act to reduce said pressure thereby preventing damage to said hydraulic cylinder.

* * * * *